US005375273A

United States Patent [19]

Bodine, Jr. et al.

[11] Patent Number: 5,375,273

[45] Date of Patent: Dec. 27, 1994

[54] LATERAL ROTATION THERAPY MATTRESS SYSTEM AND METHOD

[75] Inventors: Oliver H. Bodine, Jr., Garrison; Jack Wilkerson, Pleasant Valley, both of N.Y.

[73] Assignee: Geomarine Systems, Inc., Carmel, N.Y.

[21] Appl. No.: 154,568

[22] Filed: Nov. 19, 1993

Related U.S. Application Data

[63] Continuation-in-part of Ser. No. 968,441, Oct. 29, 1992, abandoned.

[51] Int. Cl.[5] ..... A47C 27/10

[52] U.S. Cl. ..... 5/455; 5/914

[58] Field of Search ..... 5/453, 455, 914, 456

[56] References Cited

U.S. PATENT DOCUMENTS 4,686,722 8/1987 Swart ..... 5/914
5,121,512 6/1992 Kaufmann ..... 5/453

FOREIGN PATENT DOCUMENTS 07317 7/1990 WIPO ..... 5/455

*Primary Examiner*—Michael J. Milano
*Attorney, Agent, or Firm*—John H. Crozier

[57] ABSTRACT

In a preferred embodiment, a lateral rotation therapy mattress system for a patient, including: a plurality of side-by-side longitudinal air cells; a single air chamber underlying the air cells in proximity thereto and interacting therewith to support the patient; and apparatus to supply pressurized air to the air cells and to the air chamber and to control the levels of pressure in individual ones of and/or groups of the air cells and the air chamber. The mattress may also function as a low loss air bed.

16 Claims, 6 Drawing Sheets

LATERAL ROTATION THERAPY MATTRESS SYSTEM AND METHOD

CROSS-REFERENCE TO RELATED APPLICATION

This application is a continuation-in-part of copending U.S. patent application Ser. No. 07/968,441, filed Oct. 29, 1992, now abandoned.

BACKGROUND OF THE INVENTION

1. Field of the Invention

The present invention relates to lateral rotation therapy generally and, more particularly, but not by way of limitation, to a novel lateral rotation therapy mattress system which is economical to construct and which provides improved operation over conventional lateral rotation therapy devices.

2. Background Art

A major problem in health care facilities is with bedbound patients who cannot turn or roll over without assistance. Failure of a patient to turn or roll over relatively frequently causes restriction of blood flow in the area of bony protruberances on a patient's body which, in turn, causes ulcerated bed, or pressure, sores. Such sores are extremely long-healing and, with a chronically or terminally ill patient, frequently occur. According to hospital industry sources several years ago, it was estimated that to cure a single bed sore costs society an average of $40,000 and many patients die from bed sores. Failure to regularly move a patient in bed also can result in pulmonary complications, such as pneumonia, particularly when the patient has a head injury.

A standard procedure to prevent bed sores and pulmonary complications is to have nursing personnel turn each immobile patient every two hours. This is not entirely unsatisfactory in a hospital setting where nursing staff is continually available, but may be an unsatisfactory procedure in certain institutions, such as nursing homes, or in private homes, where such assistance may not be available on a frequent basis. Nursing homes can be a particular problem where understaffed situations result in the patients not being turned as prescribed. The situation can become virtually intolerable in the private home setting where relatives may have to interrupt or wake themselves every two hours to turn the invalid who may be elderly or paraplegic; otherwise, the family is faced with the expense of retaining health care personnel merely to turn the invalid.

A major problem with manually turning the patient every two hours is that the patient is disturbed even when sleeping. Excessively heavy patients pose a particular problem.

Recently, "low-loss air beds" have been developed for the treatment and prevention of bed sores. In such a bed, the standard mattress is replaced with a plurality of air bags disposed perpendicularly to the axis of the bed from its head to its foot. The shape of the air bags permits their deformation to accommodate the contours of the patient's body without undue local pressure areas developing. A plurality of small streams of air flow from the upper surfaces of the air bags which are covered by a vapor-permeable sheet. The streams of air dry any moisture vapor which permeates through the sheet and, therefore, helps remove another cause of bed sores and reduces the frequency of bedding changes. An air bed system of the type generally described above is disclosed in U.S. Pat. No. 5,216,768, issued Jun. 8, 1993, and titled BED SYSTEM, the disclosure of which is incorporated by reference hereinto.

While low-loss air beds have greatly improved the care given immobile patients, further improvements have recently been made by the development of lateral rotational therapy beds and mattress overlays for the treatment and prevention of bed sores and the prevention of pulmonary complications. With such a bed or mattress overlay, the patient is periodically gently rolled from side to side at a rate which does not wake a sleeping patient. This promotes blood circulation on bony protruberances, greatly reduces the tendency to develop bed sores, and also greatly reduces the tendency of patients to develop pulmonary complications. A major disadvantage of such beds and mattress overlays developed so far is that, in some cases, they are relatively complicated, expensive, and/or difficult to manufacture. The beds are dedicated devices. In most cases, the beds and mattress overlays do not adequately support the patient. The mattress overlays suffer from relying on a bed mattress for support and the bed mattress is frequently too firm or too soft for proper support of the patient. Some have no means to keep a patient from rolling off. Most do not keep the patient properly positioned laterally on the bed. Some allow the patient to rise above the level of the safety rails of the bed, creating an unsafe condition. None can function as a static low loss air bed.

Accordingly, it is a principal object of the present invention to provide a lateral rotational therapy mattress system and method which are simple and economical to implement, yet permitting adequate support for the patient.

It is a further object of the invention to provide such lateral rotational therapy mattress system and method which can be used with conventional beds.

It is another object of the invention to provide such a lateral rotational therapy mattress system and method which prevent a patient from rising too high with respect to the safety rails of a bed.

A further object of the invention is to provide such a lateral rotational therapy mattress system which can function as a low loss air bed when not being used for rotational therapy.

An additional object of the invention is to provide such a lateral rotational therapy mattress system and method which provide patient flotation in the event of power failure.

Another object of the invention is to provide such a lateral rotational therapy mattress system which is configurable for either adult or pediatric patients.

Yet a further object of the invention is to provide such a lateral rotational therapy mattress system and method which maintain proper lateral position of a patient.

Yet another object of the invention is to provide such a lateral rotational therapy mattress system which is easily and economically manufactured and maintained.

Other objects of the present invention, as well as particular features, elements, and advantages thereof, will be elucidated in, or be apparent from, the following description and the accompanying drawing figures.

SUMMARY OF THE INVENTION

The present invention achieves the above objects, among others, by providing, in a preferred embodiment, a lateral rotation therapy mattress system for a patient, comprising: a plurality of side-by-side longitudinal air cells; a single air chamber underlying said air cells in proximity thereto and interacting therewith to support said patient; and means to supply pressurized air to said air cells and to said air chamber and to control the levels of pressure in individual ones of and/or groups of said air cells and said air chamber. The mattress may also function as a low loss air bed.

BRIEF DESCRIPTION OF THE DRAWING

Understanding of the present invention and the various aspects thereof will be facilitated by reference to the accompanying drawing figures, submitted for purposes of illustration only and not intended to define the scope of the invention, on which.

DETAILED DESCRIPTION OF THE PREFERRED EMBODIMENTS

Figure 1:
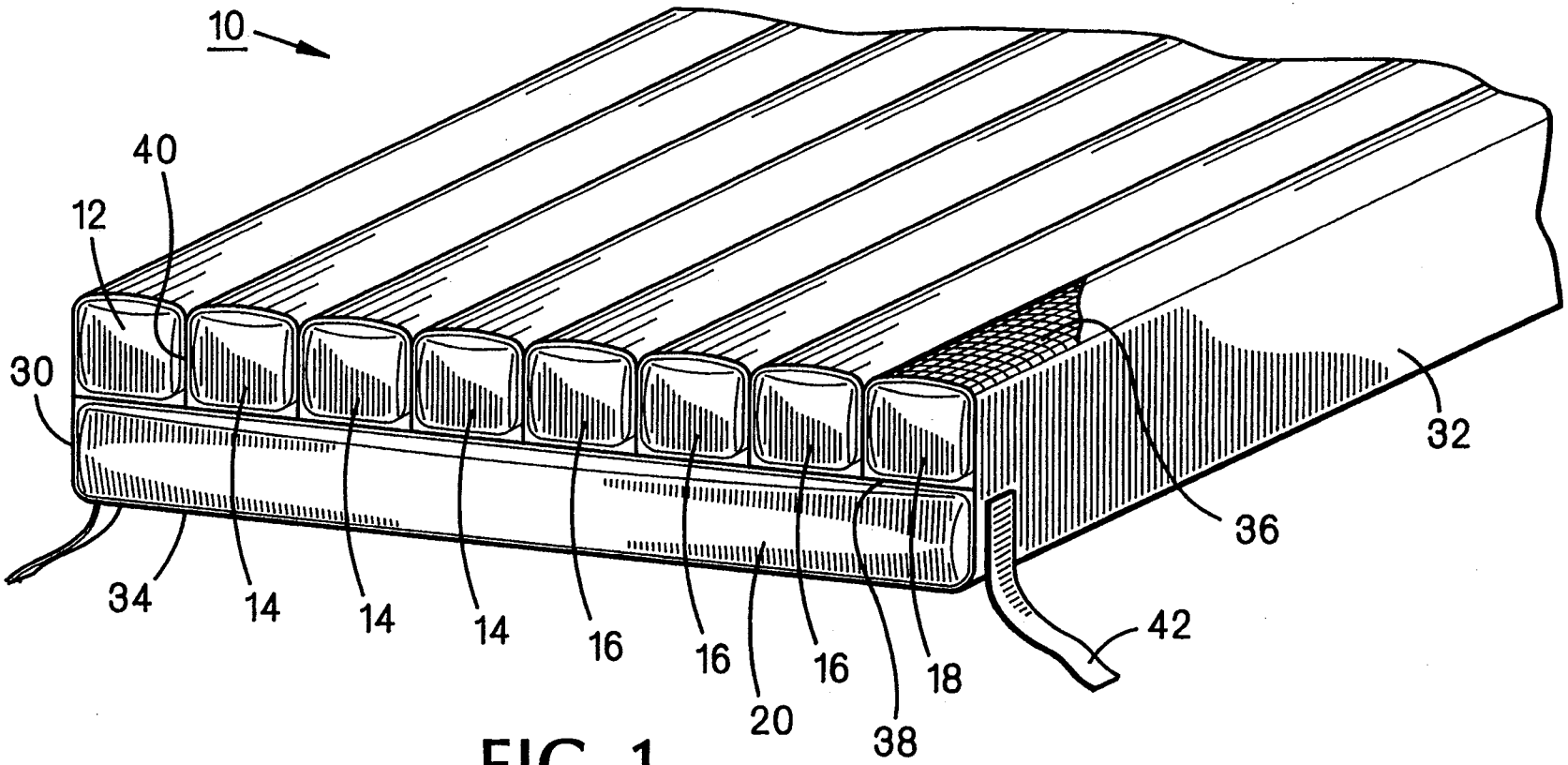
FIG. 1 is a fragmentary, perspective view of the head end of a lateral rotation therapy mattress constructed according to the present invention.

Reference should now be made to the drawing figures, on which similar or identical elements are given consistent identifying numerals throughout the various figures thereof, and on which parenthetical references to figure numbers direct the reader to the view(s) on which the element(s) being described is (are) best seen, although the element(s) may be seen also on other views.

FIG. 1 illustrates an air support structure, generally indicated by the reference numeral 10, for use in the mattress system of the present invention, which air support structure may be placed directly on the springs of a conventional hospital or other bed (not shown). Air support structure 10 includes, viewed from the head end thereof, a left outer air cell 12, three left inner air cells 14, three right inner air cells 16, a right outer air cell 18, and a lower air chamber 20. Air cells 12, 14, 16, and 18 are disposed side by side in a rectilinear, honeycomb structure formed across the top of air support structure 10, while flower air chamber 20 is disposed in a rectilinear channel below the honeycomb structure. Air cells 12, 14, 16, and 18 may be constructed of any suitable material such as a compliant vinyl or urethane impregnated Nylon material. Air cells 12, 14, 16, and 18 are cylindrical when not disposed in the honeycomb structure, but, when so disposed, are deformed to a generally rectilinear shape by the honeycomb structure.

Air support structure includes side walls 30 and 32 attached to a bottom 34, all constructed of a heavy fabric to reduce the possibility of having it snagged or punctured. The top 36 of air support structure is constructed of an air permeable fabric such as Gortex or an open weave Nylon fabric, while a horizontal divider 38 and vertical bulkheads, as at 40 between two of air cells 14, are of light fabric or plastic sheet material. Air permeable fabric 36 and bulkhead 40 are constructed of their respective materials for compliance and to minimize bunching of material as the air support structure is used. Air permeable fabric 36 also permits the flow of air therethrough when air cells 12, 14, 16, and 18 have orifices in the surfaces thereof, or are otherwise air permeable, so that air support structure 10 will serve as a low-loss bed of the type described in the above-reference application. Air support structure 10 may also be covered with a breathable cover as is described in the above-reference application.

The depths of the honeycomb structure and the lower air chamber 20 are each on the order of about 5–6 inches.

Straps 42 may be provided to releasably attach air support structure to a mattress platform or other bed structure (not shown on FIG. 1).

It will be seen that the elements of air support structure 10 form a space tensioned fabric structure that develops into a rigid assembly strong enough to support a human body, turn the body, and control/cradle the body while performing a turning function.

Figure 2:
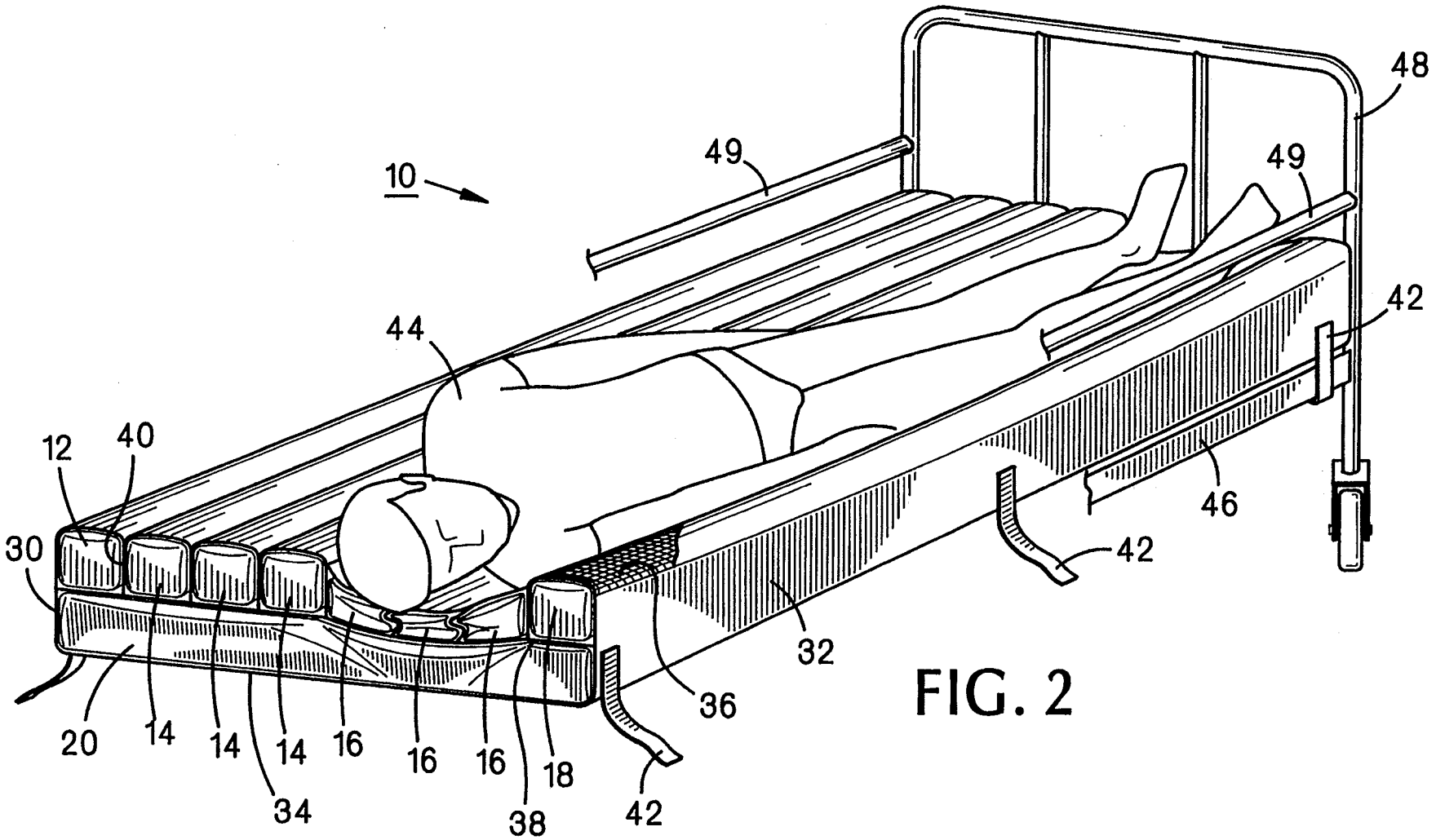
FIG. 2 is a perspective view of the mattress of FIG. 1 with a patient in rotated position thereon.

FIG. 2 illustrates air support structure 10 attached to the mattress platform 46 of a bed 48, with a patient 44 on the air support structure, the patient having been laterally rotated about 30–45 degrees, preferably about 40 degrees, to the right as viewed from the head. This has been accomplished by reducing the pressure in air cells 16, while maintaining, or slightly increasing, the pressure in air cells 14, due to an overall increase in system pressure as the air flow to air cells 16 is decreased. The pressure in lower air chamber is preset in relation to the weight of patient 44 during initial setup and remains relatively constant, except for slight overall variations in system pressure as air cells 14 and 16 are pressurized and depressurized.

An important feature of the present invention is that the level of the pressure in lower air chamber 20 is selected so that air cells 16 and lower air chamber 20 cooperate or interact such that the lower air chamber is compliantly deformed to accommodate and help support and position the body of patient 44, with a portion of the patient's body extending below the undeformed portion of the upper surface of the lower air chamber, such as the patient's right shoulder, as is indicated on FIG. 2. This interactive feature reduces the required lift height of air cells 14 and 16 and results in greatly reduced skin pressure. Otherwise, the lift height must be about 11–12 inches which leaves the patient's head unsupported when the patient is in rotated position. The low lift of air cells 14 and 16 also permits comfortably rotating a patient with the patient's back and/or feet elevated and keeps patient 44 low with respect to the safety rails 49 of bed 48. The interaction of air cells 16 and lower air chamber 20 also helps provide for maintaining patient 44 in proper lateral position on air support structure 10.

When it is desired to rotate the patient back to a supine position, the pressure in air cells 16 is gradually increased to the level of air pressure in air cells 14. If it is desired to rotate the patient to the left, the pressure in air cells 14 will be decreased, while the pressure in air cells 16 and lower air chamber 20 is maintained or increased slightly, due to overall system pressure change. The rate of rotation is very slow and gentle so as not to wake patient 44. The time for rotation from a full right rotation of about 40 degrees to a full left rotation of about 40 degrees may be 2–10 minutes or longer and is preferably about 4–5 minutes.

Figure 3:
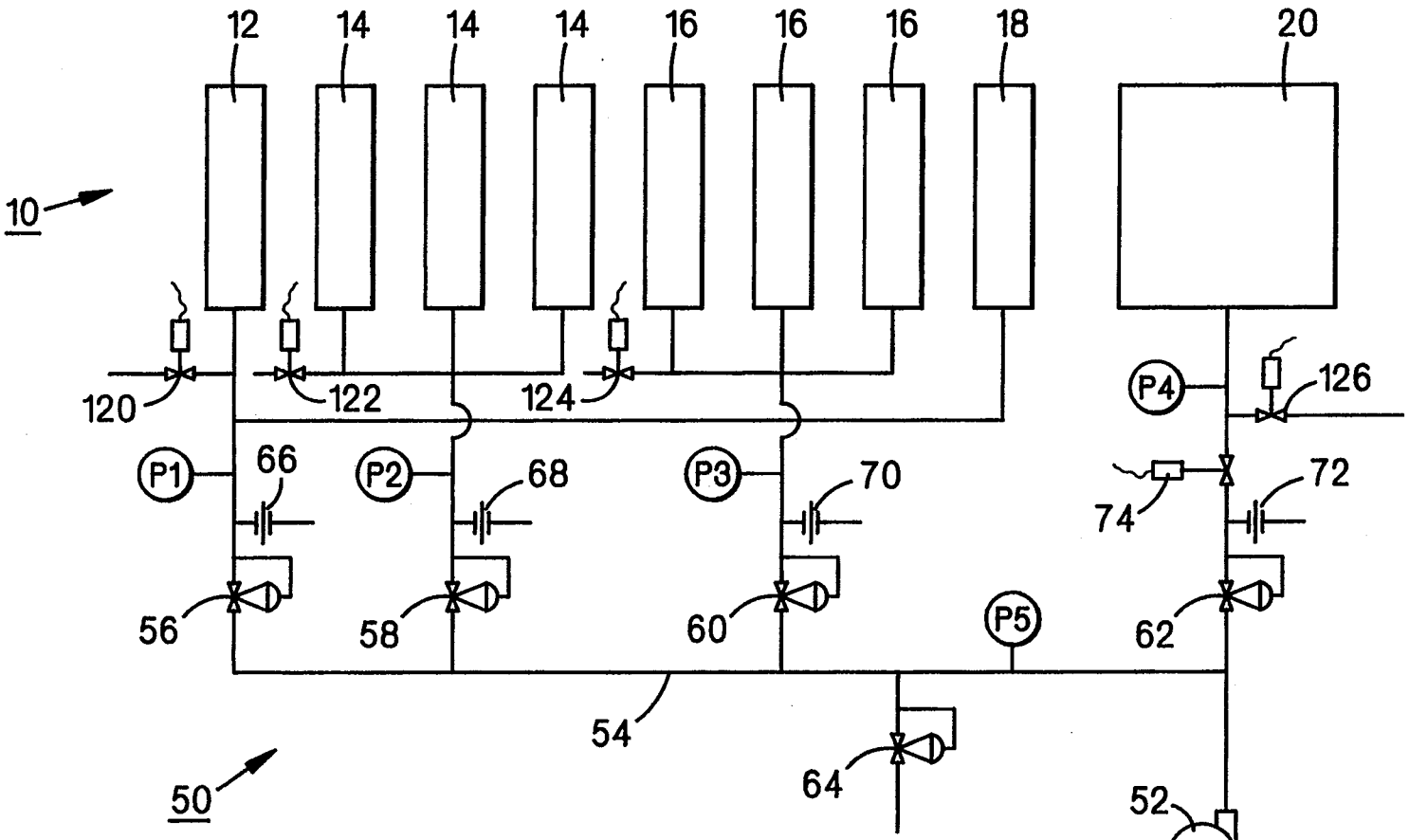
FIG. 3 is a schematic diagram illustrating an air control system for the mattress of FIGS. 1 and 2, according to the present invention.

FIG. 3 illustrates a pressure control system for air support structure 10, generally indicated by the reference numeral 50. Pressure control system 50 includes an air blower 52 which supplies pressurized air to a main manifold 54 which, in turn, provides air to air cells 12 and 18 through a pressure regulator 56, to air cells 14 through a pressure regulator 58, to air cells 16 through a pressure regulator 60, and to lower air chamber 20 through a pressure regulator 62 and a normally open solenoid valve 74. The pressure in main manifold 54 is controlled by a pressure regulator 64. For purposes of reducing pressure from a higher level, orifices 66, 68, 70, and 72 are provided downstream of pressure regulators 56, 58, 60, and 62, respectively. Should the bed system be configured also as a low loss air bed, as described in the above-referenced application, the function of orifices 66, 68, 70, and 72 would be replaced by air cell surface orifices or an air permeable material in air cells 14 and 16.

In operation, as described above with reference to FIG. 2, when the patient is in a supine position, pressures P2, P3, and P4 are held at a relatively low level for the greatest comfort of the patient, since a relatively large surface area of the patient is being supported. Pressure P1 is held at a relatively high level to ensure that the patient is maintained in proper lateral position. When P3 is reduced to partially deflate air cells 16 (FIG. 2) so that patient 44 will assume the position shown on FIG. 2, pressures P1 and P4 are increased to provide additional support for the patient, since a relatively smaller area of the patient is being supported. This also ensures that the patient is at a proper height with respect to safety rails 49.

The pressure in air cells 14 and 16 will vary from about 2 to about 16 inches of water and in lower air chamber from about 5 to about 12 inches of water, depending on the weight of the patient, and will be relatively high in air cells 12 and 18. For example, for a 150-pound patient in supine position, the pressures will be about 5 inches of water for air cells 14 and 16 and lower air chamber 20 and about 15 inches of water for air cells 12 and 18. When that patient is rotated about 30–45 degrees, preferably about 40 degrees, the pressures will be about 10 inches of water for air cells 14, about 2 inches of water for air cells 16, about 20 inches of water for air cells 12 and 18, and about 8 inches of water for lower air chamber 20.

Figure 4:
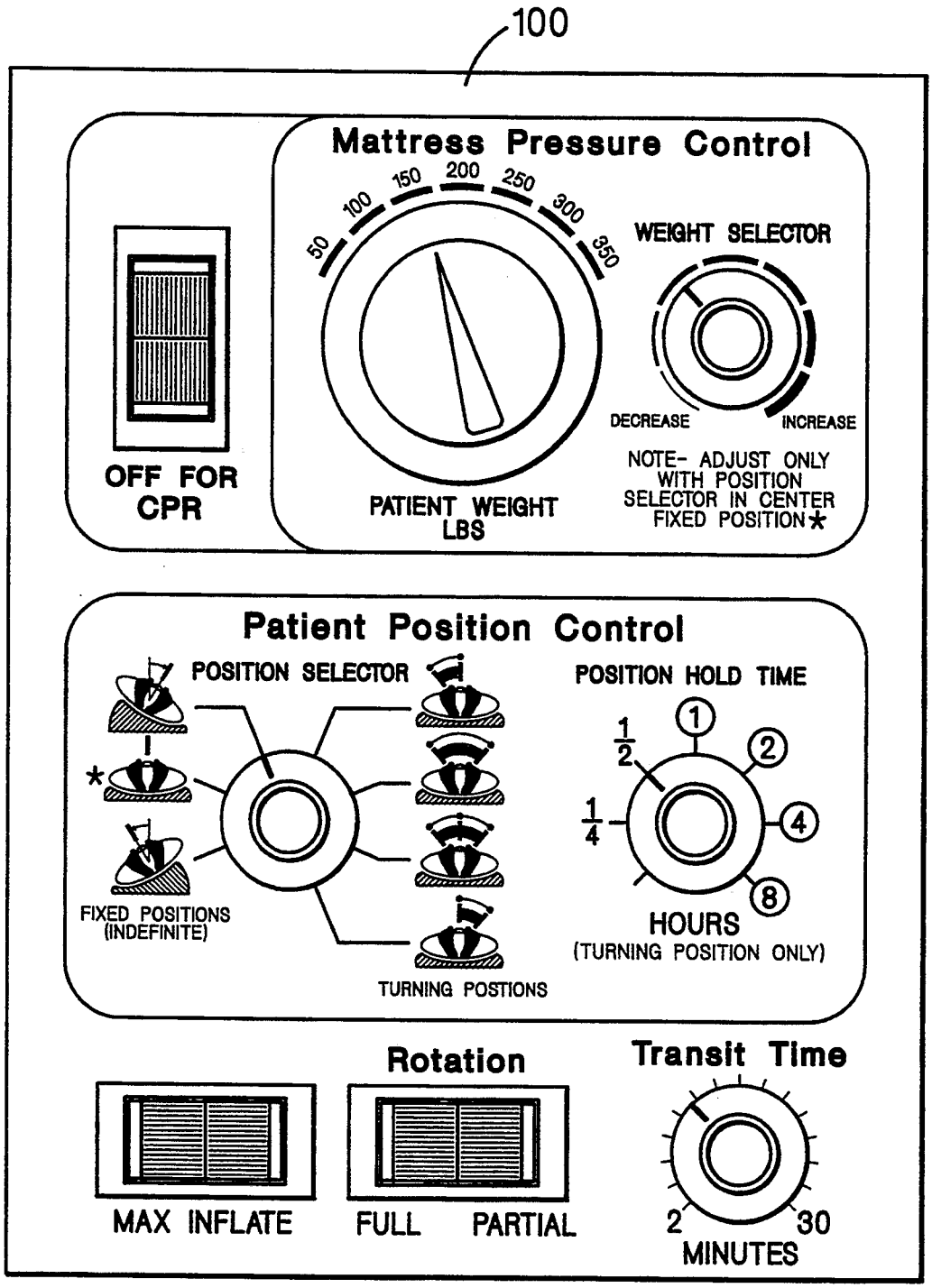
FIG. 4 is a front elevational view of the control panel for the controller of the system of FIG. 3.

The pressure control elements of FIG. 3 are connected to a controller and the control of air support structure 10 may be manual or fully automatic. FIG. 4 illustrates a control panel 100 of the controller and its functions. Patient position may be manually fixed or set to rotate between selected positions. Position hold time and transit times are selectable. The control system is calibratible for the weight of the patient. In the event a CPR procedure is necessary, an "off" switch causes a rapid deflation of all pressurized components by stopping blower 52 (FIG. 3) and opening normally closed solenoid valves 120, 122, 124, and 126 (FIG. 3). Should there be a power failure, normally open solenoid valve 74 (FIG. 3) will close and lower air chamber 20 will remain inflated to give some comfortable support to the patient. A "MAX. INFLATE" switch causes air cells 14 and 16 to deflate and pressurizes lower air chamber 20 to maximum pressure to permit easy manual turning of a patient for changing dressings and the like. This function is activatable when the patient is in any position and is useful when cardiopulmonary resuscitation (CPR) procedures are necessary.

When dealing with a smaller body, such as that of a young or elderly patient, air support structure 10 can be arranged so that outer air cell 12 and the adjacent inner air cell 14 are pneumatically interconnected and maintained at high pressure and outer air cell 18 and the adjacent inner air cell 16 are pneumatically interconnected and maintained at high pressure, while the remaining inner two pairs of air cells are used for lateral rotation.

Figure 5:
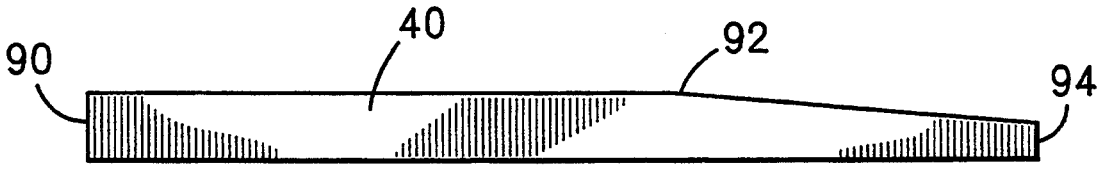
FIG. 5 is a side elevational view of a bulkhead of the mattress of FIG. 1.

FIG. 5 illustrates a preferred shape for a bulkhead 40. Here, bulkhead 40 is relatively high, say 5–6 inches in height at the head end 90 thereof, and continues this height uniformly to a point 92 approximately just below the hips of a patient and then decreases in height to the foot 94 thereof to, say 3–4 inches in height. This arrangement keeps the legs and body of a patient on the same plane and permits rotation on the same horizontal axis.

Figure 6:
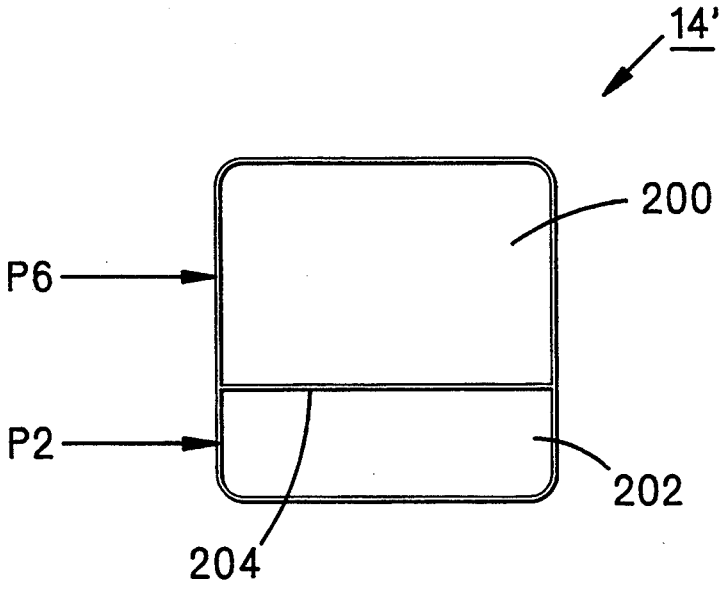
FIG. 6 is an end elevational view, in cross-section, illustrating an alternative embodiment of the present invention.

FIG. 6 shows an alternative embodiment of the present invention, here illustrated by a single air cell, generally indicated by the reference numeral 14', the alternative embodiment being useful for partially turning a patient. Partial turning is desirable, for example, in the case of severe trauma where it is necessary to gently and partially turn the patient to determine if the patient can be accommodated to rotation therapy. Air cell 14' includes upper and lower subcells 200 and 202, respectively, which extend the length of the air cell, with the height of the lower subcell being about one-third the total height of the air cell. Upper subcell 200 is supplied with air at pressure P6, while lower subcell 202 is supplied with air at pressure P2 (FIG. 3). Upper and lower subcells 200 and 202 may be formed by a horizontal septum 204 extending the length of air cell 14' or they may be individual air cells inserted in a honeycomb structure.

When it is desired to fully rotate a patient to the left, as is described above with reference to FIGS. 2 and 3, the pressures in both upper and lower subcells 200 and 202 will be reduced, with P2=P6. However, when it is desired to partially rotate a patient, P2 will be held at normal level or increased and P6 will be reduced. Since the resulting depth of deformation will be less than with single air cells, such as air cells 16 on FIG. 2, the patient will be only partially rotated.

Figure 7:
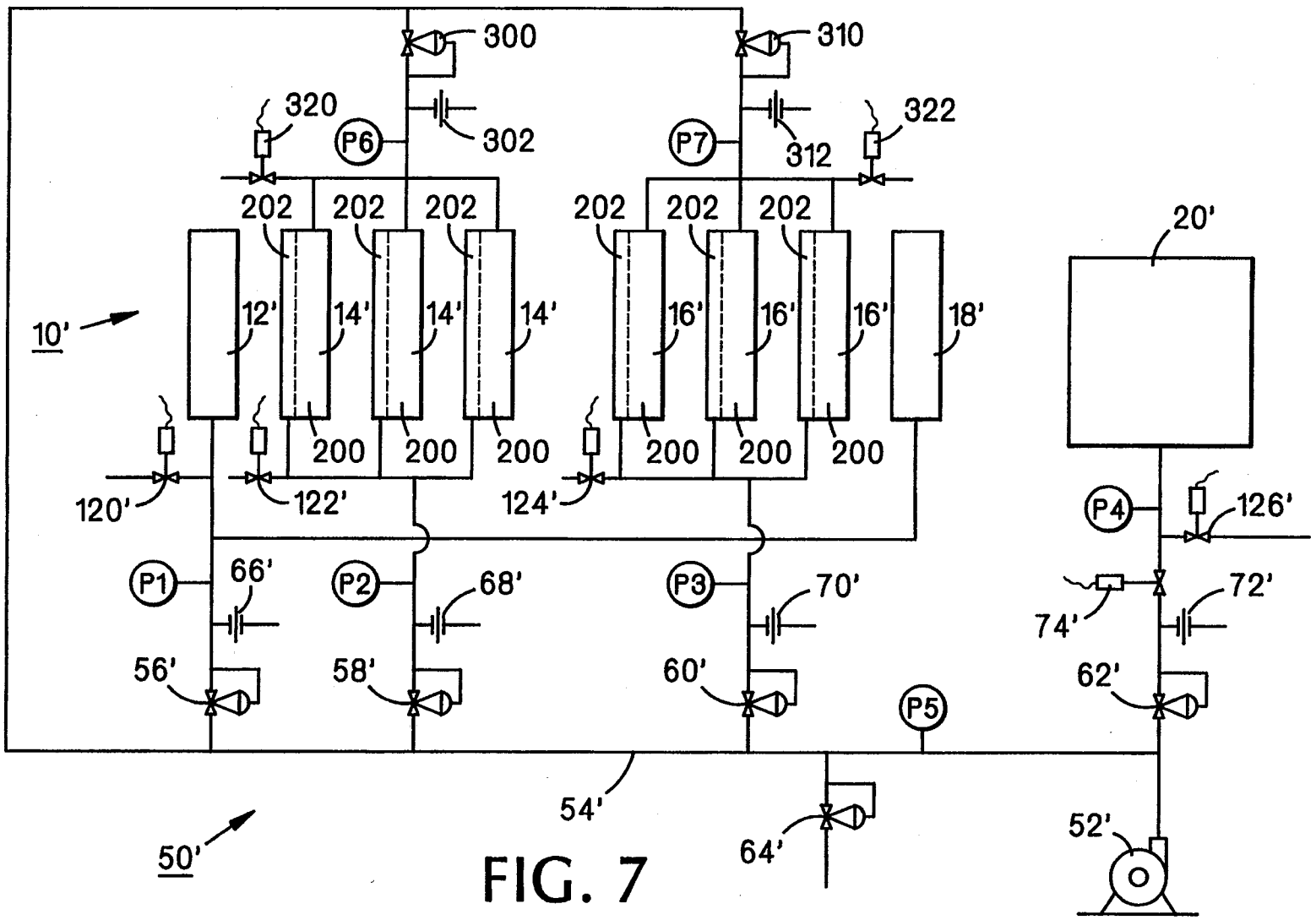
FIG. 7 is a schematic diagram illustrating an air control system for the alternative embodiment of FIG. 6, according to the present invention.

FIG. 7 illustrates a control system for the alternative embodiment, the control system being generally indicated by the reference numeral 50'. Elements of control system 50' similar to elements of control system 50 on FIG. 3 have been given primed reference numerals. These common elements, in the manner described above, will supply pressurized air to air cells 12' and 18' and to lower subcells 202 of air cells 14' and 16'.

In addition, system 50' includes an extension of manifold 54' to which is attached a pressure regulator 300, with an orifice 302 downstream thereof, to supply pressurized air to upper subcells 200 of air cells 14' at a pressure P6. Also attached to manifold 54' is a pressure regulator 310 with an orifice 312 downstream thereof, to supply pressurized air to upper subcells 200 of air cells 16' at a pressure P7. Solenoids 320 and 322 are provided to rapidly discharge air from upper subcells 200 of air cells 14′ and 16′, respectively, for manual turning of a patient or when CPR is necessary.

As indicated above, when it is desired to fully rotate patient 44 (FIG. 2), P2 will be equal to P6 and P3 will be equal to P7, at all times. When it is desired to partially rotate patient 44, P2 will be less than P6 when rotating patient 44 to the left and P3 will be less than P7 when rotating patient 44 to the right. A switch is provided on control panel 100 (FIG. 4) to select either "FULL" or "PARTIAL" rotation modes.

While air support structure 10 described with reference to FIGS. 1–4 could be revised to operate in a partial turning mode, such would require additional training and attention on the part of operating personnel. The alternative embodiment described above lends itself well to being activated by a single switching device.

Air support structures 10 and 10′ are easily constructed and the individual pressurized components thereof are easily individually replaceable if necessary.

Air support structures 10 and 10′ are easily transported, since it is constructed entirely of soft materials, and they can easily be rolled into small rolls and inserted in boxes.

It will thus be seen that the objects set forth above, among those elucidated in, or made apparent from, the preceding description, are efficiently attained and, since certain changes may be made in the above construction without departing from the scope of the invention, it is intended that all matter contained in the above description or shown on the accompanying drawing figures shall be interpreted as illustrative only and not in a limiting sense.

It is also to be understood that the following claims are intended to cover all of the generic and specific features of the invention herein described and all statements of the scope of the invention which, as a matter of language, might be said to fall therebetween.

We claim:

1. A lateral rotation therapy mattress system for a patient, comprising:
   (a) a plurality of side-by-side longitudinal air cells;
   (b) a single air chamber underlying said air cells, immediately adjacent thereto and in contact therewith, and interacting therewith to support said patient; and
   (c) means to supply pressurized air to said air cells and to said air chamber and to control the levels of pressure in individual ones of and groups of said air cells and said air chamber.

2. A system, as defined in claim 1, wherein said air cells are inserted in a rectilinear honeycomb structure having upper and lower surfaces with vertical bulkheads disposed therebetween separating said air cells.

3. A system, as defined in claim 2, wherein said upper surface of said honeycomb structure is formed of an air permeable fabric.

4. A system, as defined in claim 2, wherein said bulkheads and said lower surface are formed of a compliant material.

5. A system, as defined in claim 2, wherein said bulkheads are tapered downward from a point approximately below the hips of said patient to the foot end of said bulkhead, such that the heights of said bulkheads are less at the feet of said patient than at the torso of said patient.

6. A system, as defined in claim 1, wherein the heights of said air cells and said air chamber are on the order of about 5 to 6 inches.

7. A system, as defined in claim 1, further comprising:
   (a) said air cells being divided into first and second side-by-side groups; and
   (b) control means to decrease the pressure of said pressurized air in said second group, to cause said patient to rotate in the direction of said second group.

8. A system, as defined in claim 7, wherein said control means can selectively maintain the pressure of said pressurized air in said air cells in the range of from about 2 to about 18 inches of water and in said air chamber in the range of from about 5 to about 12 inches of water.

9. A system, as defined in claim 1, further comprising:
   (a) each said air cell being divided into an upper subcell and a lower subcell;
   (b) said means to supply pressurized air can selectively be operated to supply air of different pressures to said upper and lower subcells.

10. A system, as defined in claim 1, further comprising:
   (a) each said air cell being divided into an upper subcell and a lower subcell;
   (b) said air cells being divided into first and second groups; and
   (c) control means to decrease the pressure of said pressurized air in said upper subcells of said second group, to cause said patient to partially rotate in the direction of said second group.

11. A system, as defined in claim 1, wherein some of said air cells and a portion of the upper surface of said air chamber are simultaneously compliantly deformed by the shape of the body of said patient as said patient lies on said air cells, with a portion of said patient's body extending below an undeformed portion of the upper surface of said lower air chamber.

12. A method of preventing bed sores on, and pulmonary complications in, a patient, comprising:
   (a) providing a plurality of side-by-side longitudinal air cells;
   (b) providing a single air chamber underlying said air cells, immediately adjacent thereto and in contact therewith, to interact with said air cells to support said patient; and
   (c) periodically reducing the air pressure in one of first and second side-by-side groups of air cells while maintaining or increasing the air pressure in the other of said first and second groups of air cells so as to change the rotational position of a patient.

13. A method, as defined in claim 12, further comprising the step of increasing the air pressure in said air chamber as said patient is being rotated to one side.

14. A method, as defined in claim 12, further comprising maintaining the pressure of said pressurized air in said air cells in the range of from about 2 to about 18 inches of water and in said air chamber in the range of from about 5 to about 12 inches of water.

15. A method, as defined in claim 12, further comprising:
   (a) providing each said air cell divided into an upper subcell and a lower subcell;
   (b) providing said air cells being divided into first and second groups; and
   (c) said step of periodically reducing the air pressure in one of first and second side-by-side groups comprises reducing the air pressure in only said upper subcells in one of said first and second side-by-side groups so as to partially change the rotational position of said patient.

16. A method, as defined in claim 12, further comprising the step of a portion of said patient's body extending below an undeformed portion of the upper surface of said single air chamber.

* * * * *